US005845748A

United States Patent [19]

Schaefer et al.

[11] Patent Number: 5,845,748

[45] Date of Patent: Dec. 8, 1998

[54] LOW RESTRICTION EXHAUST BRAKE

[75] Inventors: Norman Schaefer, Pleasant Valley; Gregory T. H. Davies, Suffield, both of Conn.

[73] Assignee: Diesel Engine Retarders, Inc., Wilmington, Del.

[21] Appl. No.: 754,046

[22] Filed: Dec. 4, 1996

[51] Int. Cl.[6] ..... F02D 9/06

[52] U.S. Cl. ..... 188/273; 188/154; 123/323

[58] Field of Search ..... 188/273, 156, 188/154; 123/323, 321

[56] References Cited

U.S. PATENT DOCUMENTS

| | | | |
|---|---|---|---|
| 4,750,459 | 6/1988 | Schmidt | 188/273 X |
| 4,856,474 | 8/1989 | Tisch | 123/323 |
| 5,445,248 | 8/1995 | Clarke et al. | 188/273 |
| 5,676,110 | 10/1997 | Meneely | 123/323 |

FOREIGN PATENT DOCUMENTS

| | | | |
|---|---|---|---|
| 849439 | 8/1939 | France | 188/273 |
| 783900 | 10/1957 | United Kingdom | 188/273 |

*Primary Examiner*—Peter M. Poon

*Attorney, Agent, or Firm*—Collier, Shannon, Rill & Scott, PLLC

[57] ABSTRACT

An exhaust brake for an internal combustion engine is disclosed. The internal surfaces of the exhaust brake are aerodynamically shaped and sized to reduce the incidence of turbulent flow through the exhaust brake. The shape of the internal passage through the brake housing may be dictated by the requirement of maintaining as close to a laminar flow through the passage as possible when the brake valve is open. The ideal brake housings of the internal passage may be determined for exhaust brakes of various shapes and sizes. The ideal shapes may be typified as having non-uniform wall thicknesses. The ideal shapes of the internal brake surfaces, including that of the valve, may also be typified by the elimination of square edges (which trigger turbulence). Ideal flow through the exhaust brake may also be obtained by the reduction of bulk in the exhaust flow (minimization of the profile of the valve in the flow when the valve is open). The valve preferably has a tapered or airfoil profile, which may help reduce the valve's contribution to turbulent flow in the brake.

19 Claims, 3 Drawing Sheets

LOW RESTRICTION EXHAUST BRAKE

FIELD OF THE INVENTION

The present invention relates to exhaust brakes used in conjunction with internal combustion engines. More specifically the invention relates to the selective shaping and sizing of exhaust brake components to reduce exhaust gas restriction when the brake is not being applied.

BACKGROUND OF THE INVENTION

Presently, it is not uncommon for vehicles, such as trucks and buses, to be equipped with an aftermarket exhaust brake. Fundamentally, an exhaust brake need only comprise some means for restricting the flow of exhaust gas from an internal combustion engine. Restricting the exhaust gas increases the exhaust manifold pressure. The exhaust manifold pressure may be used to oppose the motion of the engine pistons, converting the kinetic energy of the pistons into thermal energy. The engine and vehicle may be slowed by dissipating the thermal energy that is generated. Selective restriction of the flow of exhaust gas from the engine may therefore be used to selectively brake or not brake a vehicle.

While it is desirable to increase exhaust gas restriction for braking, it is undesirable to do so when the engine is to be operated to generate positive power. With regard to positive power, fuel efficiency and power production are enhanced by the reduction of exhaust gas restriction. Unfortunately, every exhaust brake, by the nature of its presence in the exhaust system, imparts some restriction on exhaust gas flow, even when the exhaust brake is wide open and no braking is desired.

A basic known exhaust brake may include a housing, restriction means within the housing, and an actuator for the restriction means. Typically the restriction means may take the form of a valve or gate which may be rotated to open and closed positions within the housing. When in a closed position, most valves make an angle of less than ninety degrees with the housing walls, and the housing is only partially blocked (some level of exhaust gas flow must be maintained). When the valve is opened, the profile of the valve in the exhaust flow is reduced, however, there is still some noticeable restriction of exhaust flow due to the presence of the valve and the shape and size of the housing.

An example of a prior type of exhaust brake housing is shown in FIG. 1. The housing 100 is elbow shaped. The elbow shape is often necessary due to space and placement limitations for the exhaust brake. The exhaust brake may be most effective when placed in close proximity to the exhaust manifold (due in part to the compressibility of exhaust gas). The housing 100 may have a circular inlet 110 and a circular outlet 120. The size and shape of the inlet and outlet are dictated by the size and shape of the exhaust system pipes with which the housing 100 mates. The wall 130 of the housing is of constant thickness (n). The shape and thickness of the wall 130 may be solely dictated by the size and positions of the inlet and outlet relative to each other. The internal wall surface 132 is not shaped to produce any particular type of flow within the housing.

Known exhaust brakes may also be of the type disclosed in Clarke et al., U.S. Pat. No. 5,445,248 (issued Aug. 29, 1995) for an Exhaust Brake. The Clarke exhaust brake has an elbow shaped housing with a substantially constant diameter passage running therethrough. A pneumatic actuator is used to open and close a circular butterfly valve located across the curved passage of the exhaust brake housing. The butterfly valve may make a ninety degree angle with the housing wall when it is placed in a "closed" position. With reference to FIG. 2, in the Clarke brake the "open" position of the butterfly valve 200 makes a ninety degree angle with the closed position and exposes a blunt edge 210 of the valve to the flow. The combination of the blunt edge 210 and flat sides 220 of the Clarke valve act to disrupt the flow and tend to create a turbulent flow in the brake. Turbulent flow is less efficient than laminar flow in moving exhaust gas through the housing, and accordingly, turbulent flow increases the exhaust gas restriction of the brake when the valve 200 is open.

The problem of exhaust gas restriction generated by wide open exhaust brakes may be further complicated by the design goals of engine and vehicle manufacturers. These manufacturers may typically design an exhaust system to generate the maximum acceptable exhaust gas restriction without an exhaust brake. The manufacturers may need a particular level of exhaust gas restriction to stay within acceptable emissions and noise limits. The addition of an exhaust brake to such an exhaust system may result in levels of exhaust gas restriction which not only reduce engine efficiency (because maximum exhaust gas pressure is exceeded), but may also be deleterious to the operation and longevity of the engine.

Accordingly, there is a need for exhaust brakes which produce less exhaust gas restriction than previous exhaust brakes when the brake valve is open. There is also a need for an exhaust brake which discourages turbulent flow and encourages laminar flow of exhaust gas therethrough when the exhaust brake valve is open. More specifically, there is a need for an exhaust brake housing shaped and sized to produce laminar flow through the housing, and for a valve shaped and sized to reduce the disruption of laminar flow through the housing when the valve is open.

OBJECTS OF THE INVENTION

It is therefore an object of the present invention to decrease the restriction of exhaust gas through an exhaust brake when an engine is in a positive power mode of operation.

It is another object of the present invention to promote laminar flow and discourage turbulent flow through an exhaust brake in which the valve is open.

It is a further object of the present invention to provide an exhaust brake valve which is less likely to disrupt a laminar flow through an exhaust brake when the valve is open.

It is still another object of the present invention to tailor the shape and size of the internal passage of an exhaust brake housing to the laminar flow characteristics of the exhaust gas which is to flow through the passage.

It is yet another object of the present invention to tailor the shape and size of the valve of an exhaust brake to the laminar flow characteristics of the exhaust gas which is to flow through the exhaust brake.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicant has developed an innovative, economical exhaust brake comprising: a housing having an internal passage through which exhaust gas flows, said passage having a longitudinal dimension running from a first end of said housing to a second end of said housing and having a cross-sectional dimension perpendicular to the longitudinal dimension, wherein the cross-sectional dimension of said passage is selectively shaped along the longitudinal dimension of said passage to encourage a laminar flow of exhaust gas through the passage.

Applicant has also developed an innovative and economical exhaust brake comprising: a housing having an internal passage through which exhaust gas flows; and means for selectively partially blocking and unblocking said passage, said blocking and unblocking means having an axle axis therethrough and an airfoil shaped cross-section perpendicular to said axle axis.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF THE PREFERRED EMBODIMENTS

Figure 1:
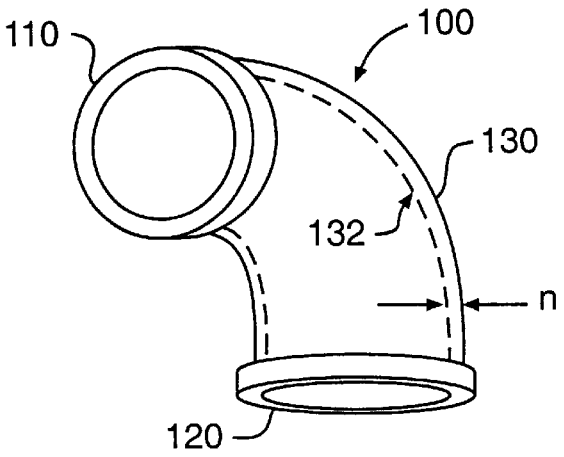
FIG. 1 (PRIOR ART)
FIG. 1 is a pictorial view of a prior art exhaust brake housing.
Figure 2:
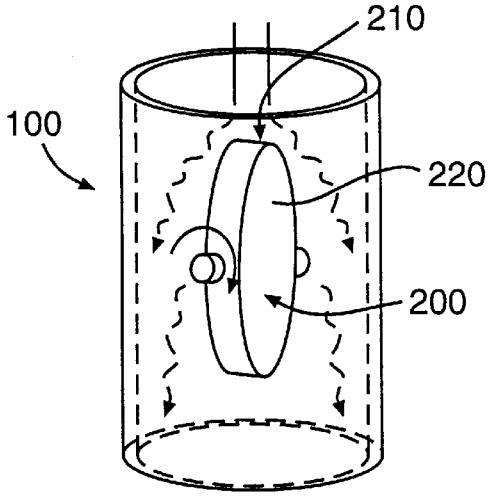
FIG. 2 (PRIOR ART)
FIG. 2 is a pictorial view of a prior art exhaust brake butterfly valve assembly.
Figure 3:
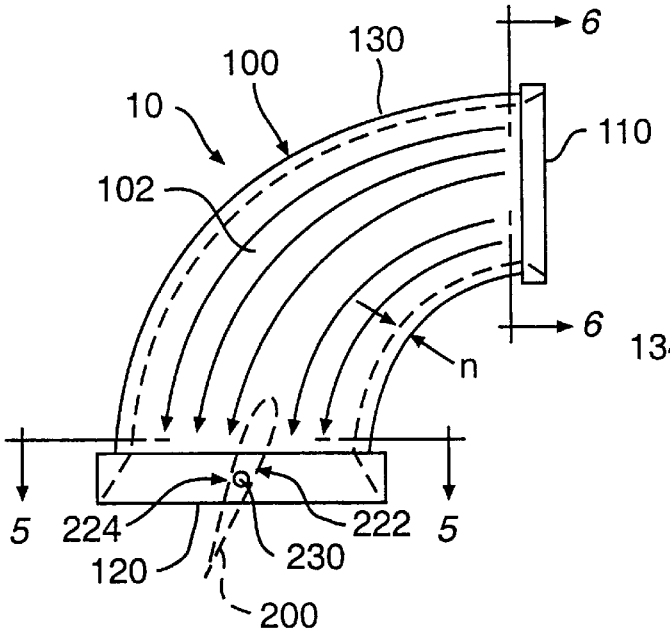
FIG. 3 is a side view in elevation of an exhaust brake embodiment of the invention.

Reference will now be made in detail to a preferred embodiment of the present invention, an example of which is illustrated in the accompanying drawings. A preferred embodiment of the present invention is shown in FIG. 3 as exhaust brake 10.

In a preferred embodiment, the exhaust brake 10 comprises a housing 100 with a passage 102 extending therethrough. The housing 100 may have an inlet 110, an outlet 120, and a wall member 130 interconnecting the inlet and the outlet. The inlet 110 may be connected to an exhaust conduit leading from an engine exhaust manifold (not shown). The outlet 120 may be connected to the remainder of a vehicle exhaust system, which may include a muffler and exhaust pipe (not shown).

The inlet 110 and the outlet 120 may have different diameters and may comprise a circular, oval, or other shaped opening. The wall member 130 may be flared in order to provide a smooth connection between the inlet 110 and the outlet 120. The wall member 130 may have a nonuniform thickness (n) between the inlet 110 and the outlet 120. The thickness of the wall member 130 may be varied such that the flow of exhaust gas through the passage 102 remains as close to a laminar flow as possible. When the engine is operating in a positive power mode, non-laminar flow (i.e. turbulent flow) through the passage 102 may result in undesirable restriction of the flow. Exemplary laminar flow streamlines are shown in the exhaust brake 10 of FIG. 3.

Figure 4:
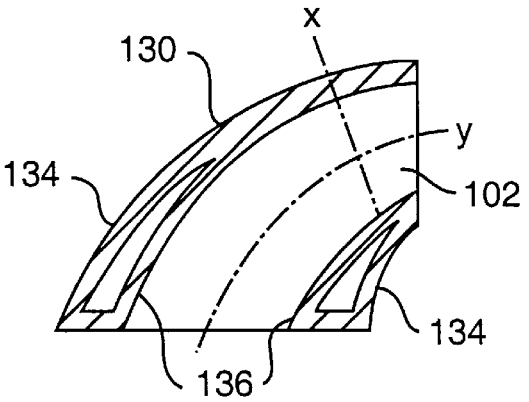
FIG. 4 is a side cross-sectional view of an exhaust brake embodiment of the invention.

With reference to FIG. 4, the wall member 130 may alternatively comprise two walls 134 and 136, between which the amount of space may be varied. By varying the space between the two walls 134 and 136, the wall member 130 may be provided with a nonuniform thickness. Reference may also be made to FIG. 4 to show that the housing passage 102 may be viewed as having a longitudinal dimension or y-axis, and a cross-sectional dimension or x-axis at each point along the longitudinal dimension.

With renewed reference to FIG. 3, the exhaust brake 10 also includes a gate or valve 200 which may be used to block and unblock the passage 102. The valve 200 may have an axle 230 running through a central region of the valve. The axle 230 may extend from the valve 200 into the housing wall 130 or into the outlet 120 to rotatably mount the valve in the passage 102 or in the outlet 120. The axle 230 may be rotated by an actuator (not shown) to open and close the valve 200 in the passage 102.

The valve 200 may have one of various airfoil shapes. Examples of airfoil shapes which may be used for the valve 200 are provided in JOHN D. ANDERSON, Jr., INTRODUCTION TO FLIGHT (2nd ed. 1985), which is incorporated herein by reference. Variations on the airfoil shapes disclosed in the INTRODUCTION TO FLIGHT book, may also be used for the valve 200 without departing from the scope or spirit of the invention. The airfoil profiles for the inner side 222 and the outer side 224 of the valve 200 may be the same or different. The particular airfoil profiles for the valve 200, as well as the size of the valve, may be dictated by the flow characteristics of the exhaust gas through the passage 102.

Figure 5:
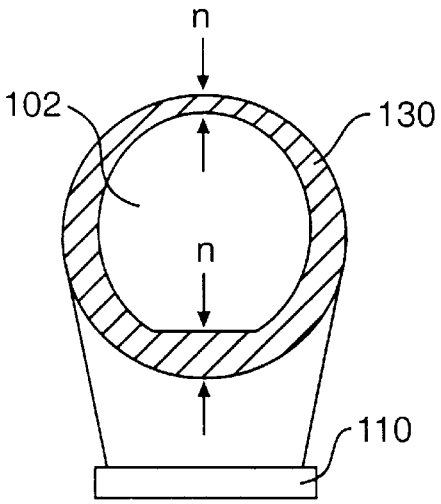
FIG. 5 is a cross-sectional view of a section of the exhaust brake embodiment of the invention shown in FIG. 3.

A cross-section FIG. 3, taken near the outlet 120, is shown in detail in FIG. 5. The wall member 130 may be clearly seen to have a non-uniform thickness (n). The thickness of the wall member 130 may be selectively varied over the length of the passage 102 such that the flow of exhaust gas through the passage 102 remains as nearly laminar as possible.

Figure 6:
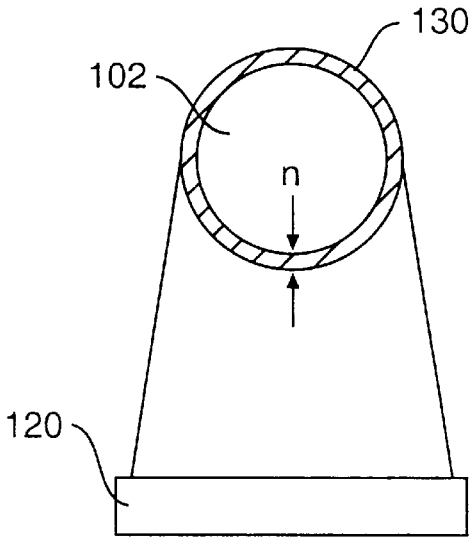
FIG. 6 is a cross-sectional view of a section of the exhaust brake embodiment of the invention shown in FIG. 3.

A cross-section of FIG. 3, taken near the inlet 110, is shown in detail in FIG. 6. The wall member 130 may be seen to start with a uniform wall thickness (n) near the inlet 110. Proceeding from near the inlet 110 towards the outlet 120, the thickness of the wall member 130 may be selectively varied.

Figure 7:
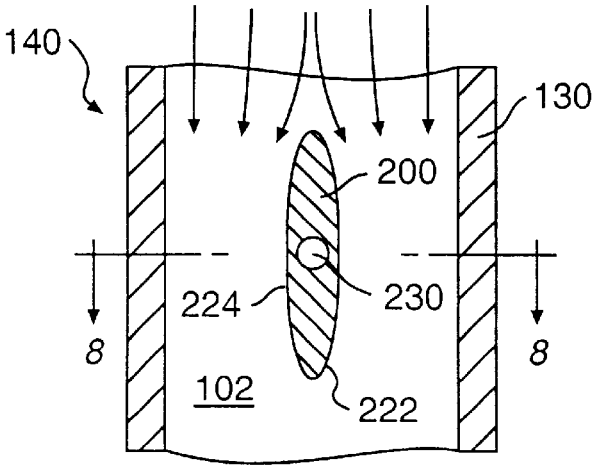
FIG. 7 is a cross-sectional view of a portion of an exhaust brake embodiment of the invention.

With reference to FIG. 7, in alternative embodiments the exhaust brake may include a straight housing portion 140. The exhaust brake valve 200 may be located in the straight portion 140. When the valve 200 is located in the center of the straight portion 140, it may be desirable to construct the valve 200 such that the airfoil profiles of the inner side 222 and the outer side 224 are substantially the same. In such a case, the valve 200 may also preferably have the minimum allowable profile exposed to the flow when the valve is in a fully open position, as it is shown in FIG. 7.

Figure 8:
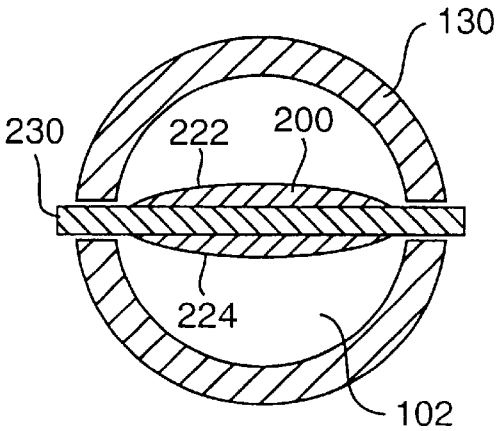
FIG. 8 is a cross-sectional view of a section of the exhaust brake embodiment of the invention shown in FIG. 7.

A cross-section, taken through the valve 200 in FIG. 7, may be viewed in detail in FIG. 8. The inner side 222 and the outer side 224 of the valve 200 may have a smooth curved profile. The profiles of the inner side 222 and the outer side 224 may be elliptical, parabolic, hyperbolic, or even flat in a portion thereof. The profile that is chosen for the valve sides may depend on which profile will result in a laminar flow, or the least turbulent flow, through the passage 102.

Figure 9A:
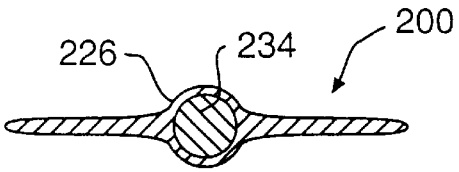
FIG. 9*a* is a cross-sectional view of a section of the butterfly valve invention of FIG. 9*c*.
Figure 9B:
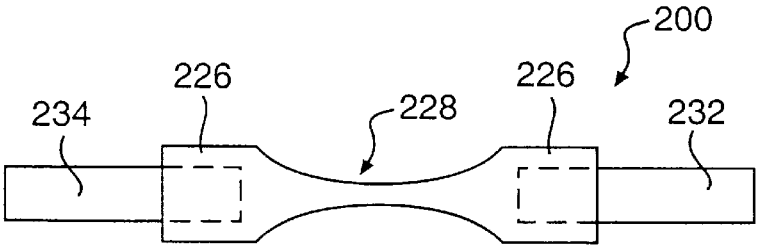
FIG. 9*b* is a front view in elevation of the butterfly valve of FIG. 9*c*.
Figure 9C:
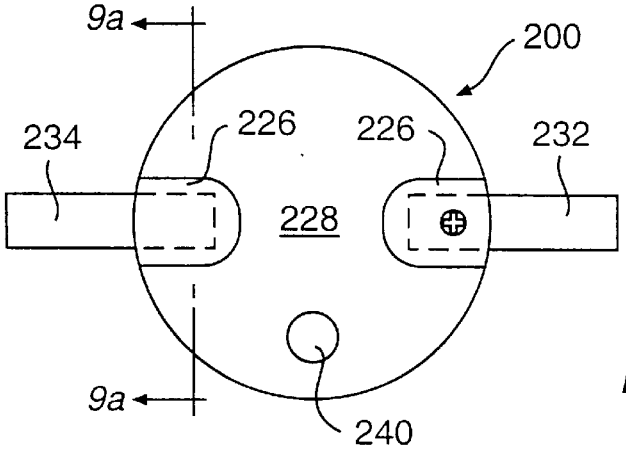
FIG. 9*c* is a top plan view of a butterfly valve embodiment of the invention.

FIGS. 9*a*, 9*b* and 9*c* are three views of an alternative embodiment of a valve 200. FIG. 9*a* shows a cross-section of the valve 200 of FIG. 9*c*, and FIG. 9*b* shows a front view of the valve of FIG. 9*c*. With reference to all three figures, the valve 200 may include rods 232 and 234. The rods may provide an equivalent for the axle 230 disclosed in the previous embodiments. The rods may be inserted into quasi-tubular portions 226 of the valve 200. The valve 200 may be considerably thinned in region 228 between the quasi-tubular portions 226. The thinned region 228 may further decrease the valve's disruption of the gas flow through the brake when the valve is in an opened position. Use of the split rods reduces the necessary profile of the valve 200 in an opened position, and may thereby reduce drag. The valve 200 may also include a through-hole 240 which may be selectively dimensioned to bleed a predetermined amount of exhaust gas from one side of the valve to the other side, when the valve is closed.

Figure 10A:
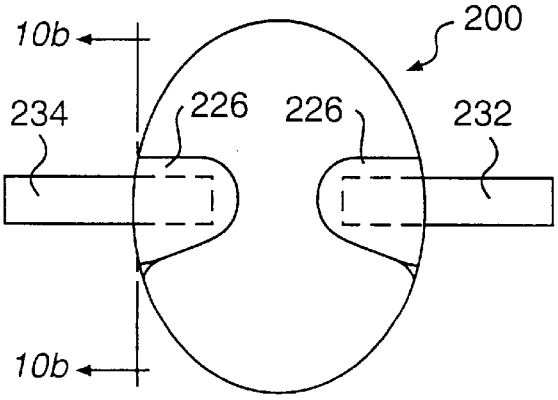
FIG. 10*a* is a top plan view of an alternative embodiment of the butterfly valve shown in FIG. 9*c*.
Figure 10B:
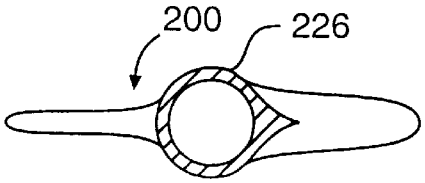
FIG. 10*b* is a cross-sectional view of a section of the butterfly valve shown in FIG. 10*a*.

FIG. 10*a* shows another alternative embodiment of a valve 200 in which the quasi-tubular portions 226 do not have a uniform profile. As is shown, the quasi-tubular portions 226 may be swept back to further reduce drag when the valve is open. The outer surface of the valve 200 may be made relatively smooth and devoid of sharp or abrupt edges to enhance the laminar flow over the valve. FIG. 10*b* shows the non-uniform profile of the quasi-tubular portion 226 shown in FIG. 10*a*.

In the above described embodiments of the invention, the internal surfaces of the exhaust brake are aerodynamically shaped and sized to reduce the incidence of turbulent flow through the exhaust brake. The shape of the internal passage through the brake housing may be dictated by the requirement of maintaining as close to a laminar flow through the passage as possible when the brake valve is open. The ideal shape of the internal passage may be determined for exhaust brakes of various shapes and sizes. The ideal housing walls may be typified as having nonuniform wall thicknesses.

The ideal exhaust brakes may also be typified by the elimination of square edges in the passage (which trigger turbulence) and the reduction of bulk in the exhaust flow (minimization of the profile of the valve in the flow). The valve preferably has a tapered or airfoil profile, which may help reduce the valves contribution to turbulent flow in the passage.

It will be apparent to those skilled in the art that various modifications and variations can be made in the construction, configuration, and/or operation of the present invention without departing from the scope or spirit of the invention. For example, in the embodiments mentioned above, various changes may be made to the shape of the passage through the exhaust brake passage, as well as to the shape of the housing surrounding the passage, without departing from the scope of the invention. Further, it may be appropriate to make additional modifications, such as to the particular type of valve which is used to block and unblock the exhaust gas passage. The valve may be provided by structure other than a rotatable butterfly valve without departing from the scope or spirit of the invention. The invention also should not be limited to application in after-market exhaust brakes. Thus, it is intended that the present invention cover the modifications and variations of the invention provided they come within the scope of the appended claims and their equivalents.

We claim:

1. An exhaust brake downstream of an exhaust manifold comprising:

an exhaust brake housing having an internal passage through which exhaust gas flows, said passage having a longitudinal dimension running from a first end of said housing to a second end of said housing and having a cross-sectional dimension perpendicular to the longitudinal dimension, wherein the cross-sectional dimension of said passage is selectively shaped along the longitudinal dimension of said passage to encourage a laminar flow of exhaust gas through the passage.

2. The exhaust brake of claim 1 wherein a cross-sectional shape of said passage is nonuniform along the longitudinal dimension of said passage.

3. The exhaust brake of claim 1 wherein a cross-sectional size of said passage is nonuniform along the longitudinal dimension of said passage.

4. The exhaust brake of claim 1 further comprising means for selectively partially blocking and unblocking said passage.

5. The exhaust brake of claim 4 wherein said blocking and unblocking means comprises an axle axis therethrough and an airfoil shaped cross-section perpendicular to said axle axis.

6. The exhaust brake of claim 4 wherein said blocking and unblocking means comprises an axle axis therethrough and an elliptical cross-section parallel to said axle axis.

7. The exhaust brake of claim 6 wherein said blocking and unblocking means comprises an airfoil shaped cross-section perpendicular to said axle axis.

8. The exhaust brake of claim 4 wherein said blocking and unblocking means comprises an axle therethrough and a parabola bound cross-section parallel to said axle axis.

9. The exhaust brake of claim 4 wherein said blocking and unblocking means comprises an axle axis therethrough and a hyperbola bound cross-section parallel to said axle axis.

10. The exhaust brake of claim 1 wherein said housing is elbow shaped.

11. An exhaust brake downstream of an exhaust manifold comprising:

an exhaust brake housing having an internal passage through which exhaust gas flows; and means for selectively partially blocking and unblocking said passage, said blocking and unblocking means having an axle axis therethrough and an airfoil shaped cross-section perpendicular to said axle axis, said blocking and unblocking means being adapted to encourage laminar flow through the passage.

12. The exhaust brake of claim 11 wherein said passage comprises a longitudinal dimension running from a first end of said housing to a second end of said housing and a cross-sectional dimension perpendicular to the longitudinal dimension; and wherein the cross-sectional dimension of said passage is selectively nonuniform along the longitudinal dimension of said passage such that there is at least a partial laminar flow of exhaust gas through the passage.

13. The exhaust brake of claim 11 wherein said blocking and unblocking means comprises an elliptical cross-section parallel to said axle axis.

14. The exhaust brake of claim 11 wherein said blocking and unblocking means comprises a parabola bound cross-section parallel to said axle axis.

15. The exhaust brake of claim 11 wherein said blocking and unblocking means comprises a hyperbola bound cross-section parallel to said axle axis.

16. An exhaust brake located downstream of an exhaust manifold comprising:

an exhaust brake housing having an internal passage through which exhaust gas flows, said passage having a longitudinal dimension running from a first end of said housing to a second end of said housing and having a cross-sectional dimension perpendicular to the longitudinal dimension; and means for selectively partially blocking and unblocking said passage, wherein the cross-sectional dimension of said passage is selectively shaped along the longitudinal dimension of said passage to discourage a turbulent flow of exhaust gas through the passage.

17. An exhaust brake downstream of an exhaust manifold comprising:

an exhaust brake housing having an internal passage through which exhaust gas flows, said passage having a longitudinal dimension running from a first end of said housing to a second end of said housing and having a cross-sectional dimension perpendicular to the longitudinal dimension; and means for selectively partially blocking and unblocking said passage, said means for blocking and unblocking having an airfoil shaped cross-section, wherein the cross-sectional dimension of said passage is selectively nonuniform along the longitudinal dimension of said passage to minimize exhaust gas flow restriction through the passage when said blocking and unblocking means is in an unblocking position.

18. An exhaust brake downstream of an exhaust manifold comprising:

an exhaust brake housing having an internal passage through which exhaust gas flows; and a valve comprising:

first and second quasi-tubular ports;

first and second rods, communicating with said first and second quasi-tubular ports, respectively, and supporting said valve within said housing; and a thinned region, intermediate of said first and second quasi-tubular ports, wherein the surface of said valve is devoid of sharp edges to enhance the occurrence of laminar flow over the surface of the valve when the valve is in an opened position within the housing.

19. The exhaust brake of claim 18 wherein said quasi-tubular ports have a non-uniform profile as viewed in cross-section.

* * * * *